United States Patent [19]

Reuss

[11] Patent Number: 4,659,164

[45] Date of Patent: Apr. 21, 1987

[54] DIODE CONNECTOR

[75] Inventor: Oswald Reuss, Unterelsbach, Fed. Rep. of Germany

[73] Assignee: Preh Elektrofeinmechanische Werke, Jakob Preh, Nachf. GmbH & Co., Bad Neustadt, Fed. Rep. of Germany

[21] Appl. No.: 728,186

[22] Filed: Apr. 29, 1985

[30] Foreign Application Priority Data

Apr. 30, 1984 [DE] Fed. Rep. of Germany ..... 84132264[U]

[51] Int. Cl.[4] ..... H01R 4/48

[52] U.S. Cl. ..... 339/143 R; 339/103 M; 339/258 P; 339/275 T

[58] Field of Search ..... 339/275 T, 223 R, 97 C, 339/256 R, 258 R, 136 R, 103 R, 103 M, 143 R

[56] References Cited

U.S. PATENT DOCUMENTS

| | | | |
|---|---|---|---|
| 3,296,577 | 1/1967 | Travis et al. | 339/258 R |
| 3,495,205 | 2/1970 | Ricci | 339/256 R |
| 3,543,217 | 11/1970 | Klumpp, Jr. | 339/258 R |
| 3,665,367 | 5/1972 | Keller et al. | 339/275 T |
| 3,721,943 | 3/1973 | Curr | 339/217 S |
| 3,926,499 | 12/1975 | Bailey et al. | 339/136 R |
| 4,304,454 | 12/1981 | Yokota et al. | 339/97 C |

FOREIGN PATENT DOCUMENTS

| | | | |
|---|---|---|---|
| 3023232 | 1/1982 | Fed. Rep. of Germany . | |
| 3237159 | 3/1984 | Fed. Rep. of Germany . | |
| 26926 | 5/1956 | France | 339/136 R |

*Primary Examiner*—John McQuade

*Attorney, Agent, or Firm*—Woodcock, Washburn, Kurtz, Mackiewicz & Norris

[57] ABSTRACT

A diode type connector having at least one solid guide pin inserted through an insulated housing, the pin having a front plug portion and a rear section for connection to a strand of a cable, the rear section having an axial concentric bore and a lateral slot located within the bore, and a connector terminal part having a connector part extending rearward for crimping onto the cable strand and a sleeve-like contact spring part having a length about that of the pin rear section and extending forward from engaging the pin rear section. The cable strand can either be soldered directly into the bore, or connected to the pin with the connector terminal part.

4 Claims, 3 Drawing Figures

DIODE CONNECTOR

BACKGROUND OF THE INVENTION

This invention relates to a plug connector and, more particularly, to a diode type plug connector having a plurality of pins and a terminal part for connecting separate strands of a cable to respective ones of said pins.

Electrical plug connectors are used in almost all areas of electrical and electronic technology, and there is a correspondingly large number of embodiments of such connectors. Plug connectors are generally used for repeated connection or disconnection of electrical circuits, in which their primary task is to effect reliable and reproducible electrical contact or disconnection over a rather long period of time under predetermined mechanical, electrical and environmental operating conditions. In order to adapt to these operating conditions in an optimal manner, there exist many embodiments adapted for different particular purposes. The plug connector described below represents a type of connector used for example in radio or television equipment, or in phonograph equipment. Even within this narrower group of plug. connectors, there is a very large number of embodiments, distinguished from one another for example by the fact that additional disconnection or switching contacts are present, or by the fact that a different number of contact springs are provided, which may additionally have different geometric arrangements.

The plug connector according to the following description is characterized as a so-called miniature plug connector or a diode plug connector. It is more common for the cable, particularly a multi-stranded cable, to be soldered to the connector, and secured to the connector housing by means of a cable clamp acting as strain relief. When the cable used is a multi-stranded cable with five or more strands, the soldering process requires significant time and a certain degree of dexterity. Besides soldering, there are other known methods of connecting cables and plug connectors, including screw fastening, wire-wrapping, termi-point connection, plugging, crimping, press-fitting, and cut gripping-/push fitting.

German Pat. No. 30-23-232 has already disclosed an electrical pin element for electrical plug connections, which is made of solid material and has an axial peg at the end opposite the pin. Onto this pin is pressed a cable terminal part which is made of sheet material and has a tubular, axially slotted part and a cable terminal part. To ensure a durable, tight connection between the pin element and the cable terminal part, connection by means of soldering or brazing is anticipated. The cable terminal part consists of tabs arranged in two zones. The tabs in the first zone grip the conductor, from which the insulation has been stripped, while the tabs in the second zone surround the conductor insulation.

German Pat. No. 32-37-159 discloses another pin-type contact element for electrical plug connectors, which is equipped at the end opposite the pin with an axial, concentric bore. The cable terminal part, made of sheet material, has a springy tubular part, which is pressed snugly into the bore of the contact element. A cylindrical insert pin, which has a wedge-shaped projection at one end, is pressed into the hollow of the tubular part. This produces a clamp connection between the contact element and the cable terminal part.

In addition to this generally non-positive connection, this drive device also provides for a locking type of connection, for which the edge of the bore is pressed onto the insert pin. In this case as well, the cable terminal part has tabs distributed over two zones, such that the tabs in the first zone serve to grip the conductor, from which the insulation has been removed. The tabs in the second zone surround the conductor insulation.

SUMMARY OF THE INVENTION

The object of the present innovation is to create a diode type plug connector in which a preferably multi-strand cable can be connected with one or more guide pins, optionally in a removable or non-removable manner, such that when a removable connection is made, the cable can more easily be placed into contact with the conductor terminal part. In accordance with the above object, there is provided a diode type connector having at least one solid guide pin inserted through an insulating housing, the pin having a rear section, a conductor terminal part configured to fit snugly onto said rear section, the terminal part having a connector part extending rearward for crimping onto a cable and a sleeve-like contact spring part extending forward for engaging said rear section, the rear section having an axial concentric bore and a lateral slot located within the bore, the contact spring part being approximately the length of said rear portion and having an enlargement at its opening.

DESCRIPTION OF THE PREFERRED EMBODIMENT

Figure 1:
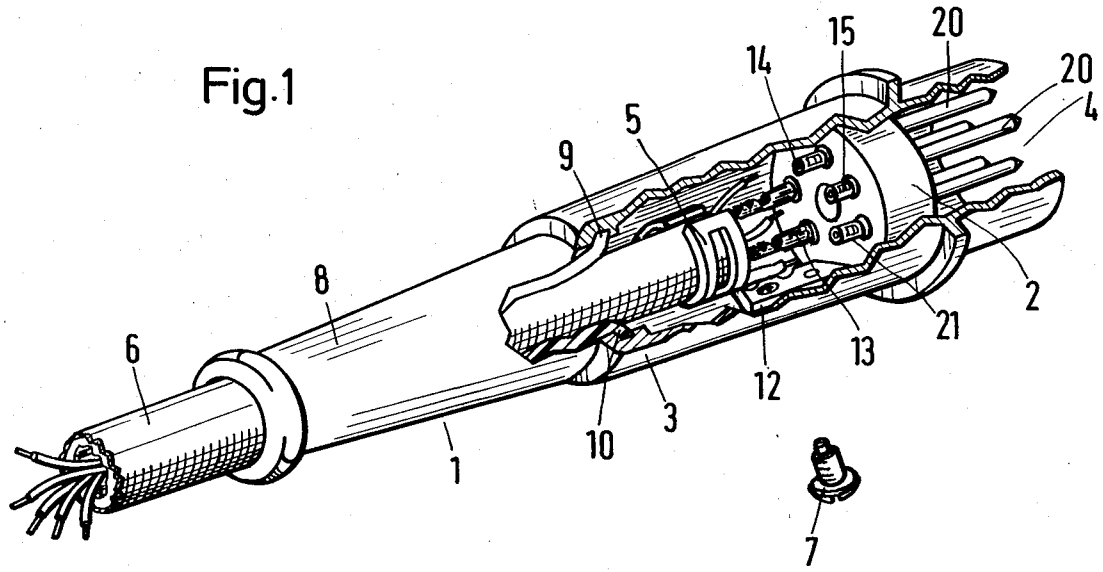
FIG. 1 is a perspective view of a diode connector according to the invention.

In FIG. 1, the numeral 1 indicates the diode connector of this invention. It consists of an insulating housing 2 made of plastic into which a number of guide pins 4, arranged in a circle, are inserted. The front side of each pin constitutes the plug 20, while on the back side is a rear section 21, to which the cable can be electrically connected. The connection may be made alternatively as desired by soldering or by means of a plug connection.

A tubular, electrically conductive sleeve 3 is slid over the insulating housing 2, the sleeve being made of a single piece of pressure-cast zinc which is then galvanically covered with a coating, for example a nickel coating. It has a lateral hole into which a screw 7 can be threaded. Attached to one side of the sleeve 3 is a rubber bushing 8, and the sleeve 3 has an annular groove 9 which engages with a collar-like bead 10 on the rubber bushing. A clip 12 made of sheet material is attached to the sleeve 3 by means of the screw 7, and the clip 12 is in turn attached to the insulating housing 2. The insulating housing also has a T-shaped cutout, not visible in the Figures, into which part of an I-shaped element of the clip 12 fits (i.e. a cross member and the connecting member of the I-shaped element). The opposite end of clip 12 has two clip portions 5, which are wrapped around the cable 6 next to the rubber bushing 8 and provide strain relief for the cable connected to the guide pins. Since the outside diameter of the insulating housing 2 is the same as the inside diameter of the sleeve 3 which surrounds it, after tightening of the screw 7 the insulating housing is immovably attached. The cross-members of the T-section and the lower cross-member of the I-section prevent the insulating housing from being pulled out, while the upper cross-member of the I-section, which engages with the upper edge of the insulating housing, prevents it from being pushed inward. In addition, the longitudinal member of clip 12 provides the required protection against twisting. The clip 12 made of sheet material can also be attached to the insulating housing by means of a riveted ear placed in the middle of the insulating housing.

The guide pin 4 is made of a solid piece of material, and has an axial, concentric bore 14 at its rear section 21. Within the length of the bore is a slot 15 which extends laterally to connect with (i.e. extends into) the bore. The slot 15 is window-like or enclosed, i.e. surrounded on four sides by the side wall of the pin 4. This construction makes it possible to solder a cable 6 with a number of strands 11 onto the rear sections of the pins, since the stripped end of each strand projects into the bore and hot solder can be caused to flow through the slot. However, soldering of a number of strands requires a certain degree of skill, particularly in order to avoid short circuits. A simpler process involves sliding sprung conductor terminal part 16 snugly onto the guide pin 4 so as to connect it to the strand 11.

Figure 2:
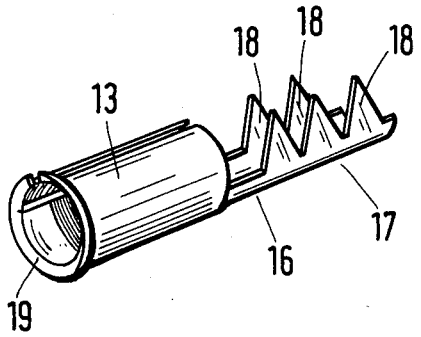
FIG. 2 is a perspective view of a conductor terminal part of the diode connector of this invention.
Figure 3:
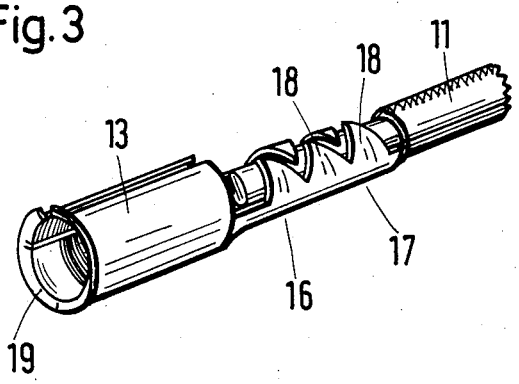
FIG. 3 is a perspective view of the conductor terminal part connected to one strand.

As seen in FIGS. 2 and 3, each conductor terminal part 16 consists of a contact spring part 13 and a connector part 17. The connector part 17 consists of projecting tabs 18, which taper to a point at their free ends. When the tabs are wrapped around the individual strands of the cable, their points pierce the insulation of the strands. This process can be done manually or by a machine. At the front end of the conductor terminal part is the sleeve-shaped contact spring part 13. This is produced by being punched out of a ribbon-like tinned strip material and then bent in half. To make it easier to slide the contact part 13 onto the guide pin 4, the contact spring part 13 has an enlargement 19 at its opening. Preferably, the contact spring part is approximately the length of the rear section of the guide pin to optimize the mechanical connection.

As illustrated herein, the connector is disclosed for connection to one or more strands of a cable. Of course, it is understood that the connection may be made to a plurality of conductive elements in the nature of strands, wires, or the like.

What is claimed is:

1. A diode connector for providing at least one electrical connection to a cable, having at least one guide pin made of a solid material, an insulating housing with said guide pin inserted into and through said housing, said pin having a connector portion on a front side of said housing and a rear section on a back side of said housing, and a conductor terminal part configured to be fitted snugly onto said rear section, said conductor terminal part consisting of a connector part at one end for crimping onto said cable and a sleeve-like contact spring part at an opposing end, characterized by the fact that said rear section has an axial, concentric bore having a length through the pin and an enclosed lateral slot which extends through a sidewall of said rear section of the guide pin within the length of said axial bore and into said pin as far as said bore, said contact spring part being approximately the length of said rear section and having an enlargement at its opening.

2. The diode connector according to claim 1, wherein said terminal part has projecting tabs which taper to a point at their free ends.

3. The diode connector according to claim 1, comprising a plurality of said pins.

4. The diode connector according to claim 1, comprising a tubular electrically conductive sleeve slid over said insulating housing.

* * * * *